US010480907B2

(12) United States Patent
Klassen et al.

(10) Patent No.: US 10,480,907 B2
(45) Date of Patent: Nov. 19, 2019

(54) BALLISTIC ART

(71) Applicant: Cardinal Technologies LLC, Plymouth, MN (US)

(72) Inventors: Loren R. Klassen, Plymouth, MN (US); James M. Prom, Plymouth, MN (US)

(73) Assignee: Cardinal Technologies LLC, Plymouth, MN (US)

( * ) Notice: Subject to any disclaimer, the term of this patent is extended or adjusted under 35 U.S.C. 154(b) by 0 days.

(21) Appl. No.: 15/994,089

(22) Filed: May 31, 2018

(65) Prior Publication Data

US 2018/0372455 A1 Dec. 27, 2018

Related U.S. Application Data

(60) Provisional application No. 62/516,951, filed on Jun. 8, 2017.

(51) Int. Cl.
*F41H 5/08* (2006.01)
*F41H 5/013* (2006.01)
(Continued)

(52) U.S. Cl.
CPC ..... *F41H 5/08* (2013.01); *F41H 5/013* (2013.01); *F41H 3/02* (2013.01); *F41H 5/04* (2013.01);
(Continued)

(58) Field of Classification Search
CPC ... F41H 5/08; F41H 5/013; F41H 3/02; F41H 5/04; G09F 15/0006; G09F 15/0056; G09F 23/00; G09F 15/0012; G09F 15/005
(Continued)

(56) References Cited

U.S. PATENT DOCUMENTS 1,281,400 A * 10/1918 Larnell ..... F41H 5/14 109/49.5
2,209,654 A * 7/1940 Loeser, Jr. ..... F41H 5/08 109/49.5
(Continued)

OTHER PUBLICATIONS

Coffee, "Ogilvy Made Bulletproof Ads to Protest Lax Gun Laws and Put One in Front of the White House," dated on Apr. 27, 2017, http://www.adweek.com/creativity/ogilvy-made-bulletproof-ads-to-protest-lax-gun-laws-and-put-one-in-front-of-the-white-house, 2 pages.
(Continued)

*Primary Examiner* — Michelle Clement
(74) *Attorney, Agent, or Firm* — Patterson Thuente Pedersen, P.A.

(57) ABSTRACT

A ballistic art shield that includes an outwardly-facing surface, an inwardly-facing surface, and a ballistic resistant material. The outwardly-facing surface has a generally planar configuration and the inwardly-facing surface is oriented in an opposing direction to the outwardly-facing surface. The inwardly-facing surface has a generally planar configuration and includes at least one handle that is adjustable to a low profile position with respect to the inwardly-facing surface. The ballistic resistant material is disposed between the outwardly-facing surface and the inwardly facing surface. The outwardly-facing surface includes a shroud for concealing the ballistic resistant material and has a disguised appearance resembling a wall-hung interior wall décor item.

17 Claims, 15 Drawing Sheets

(51) Int. Cl.
*G09F 15/00* (2006.01)
*G09F 23/00* (2006.01)
*F41H 3/02* (2006.01)
*F41H 5/04* (2006.01)

(52) U.S. Cl.
CPC ..... *G09F 15/005* (2013.01); *G09F 15/0012* (2013.01)

(58) Field of Classification Search
USPC ..... 89/36.07
See application file for complete search history.

(56) References Cited

U.S. PATENT DOCUMENTS 2,370,596 A * 2/1945 Wallace ..... F41H 5/08 109/49.5
4,016,666 A * 4/1977 Finn ..... F41A 17/56 42/1.01
4,245,546 A * 1/1981 Chaires ..... F41H 5/14 109/49.5
4,404,889 A * 9/1983 Miguel ..... F41H 5/0442 89/36.02
4,412,495 A 11/1983 Sankar
4,678,702 A 7/1987 Lancaster et al.
4,781,101 A * 11/1988 Zevuluni ..... F41H 5/14 109/49.5
5,340,189 A 8/1994 Goodman
5,438,908 A 8/1995 Madden, Jr.
5,756,922 A 5/1998 Fuller
6,000,347 A * 12/1999 Madden, Jr. ..... A45C 9/00 109/22
6,272,781 B1 * 8/2001 Resnick ..... F41H 1/00 2/2.5
6,279,449 B1 * 8/2001 Ladika ..... F41H 5/007 89/36.02
6,619,180 B1 * 9/2003 Hoover ..... F41H 3/00 89/36.02
6,622,607 B1 * 9/2003 Miller ..... F41H 5/06 2/2.5
6,845,701 B2 * 1/2005 Drackett ..... F41H 5/14 89/36.09
6,907,811 B2 * 6/2005 White ..... F41H 5/06 109/49.5
7,102,814 B1 * 9/2006 Hughes ..... F41H 3/00 250/504 R
7,124,675 B1 10/2006 Sand
7,302,880 B1 * 12/2007 Elasic ..... F41H 5/08 89/36.01
7,520,207 B1 * 4/2009 Fuqua ..... F41H 5/013 109/82
7,584,689 B2 * 9/2009 Jones ..... B32B 17/10009 89/36.02
7,594,515 B2 * 9/2009 Prock ..... F41H 3/00 135/115
8,015,910 B1 * 9/2011 Fuqua ..... F41H 5/14 89/36.01
8,080,487 B2 12/2011 Gardner et al.
8,272,309 B1 * 9/2012 Cumberland ..... F41H 5/0414 89/36.02
8,327,748 B2 * 12/2012 Conroy ..... F41H 5/06 89/36.02
8,863,634 B1 * 10/2014 Lou ..... F41H 5/0464 89/36.02
9,090,116 B2 * 7/2015 Tunis ..... F41H 5/08
9,168,779 B2 * 10/2015 Krapf ..... B43L 1/00
9,347,748 B1 * 5/2016 Crisp ..... F41H 5/08
9,448,041 B2 * 9/2016 Gonda ..... F41H 5/14
9,616,261 B1 * 4/2017 Rambert ..... E04B 1/94
9,885,539 B2 * 2/2018 Spransy ..... F41C 27/04
9,982,968 B2 * 5/2018 Thomas ..... F41H 5/08
2003/0110932 A1 * 6/2003 Mohr ..... B32B 3/10 89/36.02
2004/0255769 A1 * 12/2004 Drackett ..... F41H 5/14 89/36.09
2005/0053769 A1 * 3/2005 Imblum ..... F41H 5/08 428/170
2005/0217472 A1 * 10/2005 Baker ..... F41H 5/08 89/36.06
2006/0230916 A1 * 10/2006 Sand ..... F41H 3/00 89/36.07
2007/0131103 A1 * 6/2007 McClellan ..... F41H 5/12 89/37.03
2007/0193441 A1 * 8/2007 Carter ..... F41H 5/08 89/36.07
2007/0283477 A1 * 12/2007 Dovner ..... F41C 33/0209 2/2.5
2008/0047860 A1 * 2/2008 Shane ..... F41A 17/02 206/317
2008/0087684 A1 * 4/2008 Koshimoto ..... B65D 83/20 222/192
2009/0294499 A1 * 12/2009 McKinney ..... A45C 13/08 224/576
2010/0083820 A1 * 4/2010 Doyner ..... F41H 5/08 89/36.02
2011/0011255 A1 * 1/2011 Kleniatis ..... F41H 5/08 89/36.09
2011/0226123 A1 * 9/2011 Priebe ..... F41H 5/08 89/36.02
2012/0174768 A1 * 7/2012 Spransy ..... F41H 5/013 89/36.09
2012/0247313 A1 * 10/2012 Peters ..... A47C 3/04 89/36.02
2014/0000195 A1 * 1/2014 Daniels ..... B32B 13/02 52/232
2014/0013934 A1 * 1/2014 Inglefield ..... F41H 5/023 89/36.02
2017/0167829 A1 * 6/2017 Thomas ..... F41H 5/08

OTHER PUBLICATIONS

Schmidt, "Thirteen Years of Shootings," New York Times, Sep. 24, 2014, https://www.nytimes.com/2014/09/25/us/25shooters.html, 4 pages.
King et al., "Mass Shootings Have Become More Common in the U.S.: How Common Are Mass Shootings?," https://fivethirtyeight.com/features/mass-shootings-have-become-more-common-in-the-u-s/ Dec. 2, 2015, 5 pages.
Diamond, "Mass Shootings Are Rising. Here's How to Stop Them." Forbes, Jun. 18, 2015, https://www.forbes.com/sites/dandiamond/2015/06/18/charleston-deaths-are-an-american-tragedy-mass-shootings-are-rising/#753bdaaa787b, 5 pages.

* cited by examiner

BALLISTIC ART

RELATED APPLICATION

The present application claims the benefit of U.S. Provisional Application No. 62/516,951 filed Jun. 8, 2017, which is incorporated herein in its entirety by reference.

TECHNICAL FIELD

This disclosure relates to ballistic art, and more particularly, to ballistic art shields which contain concealable ballistic material that is integrated within items such as artwork, posters, banners, wall-hangings, signs, signboards, and photographs to provide readily-accessible protection from lethal forces at facilities or sites that are potential locations for attack.

BACKGROUND

Modern society has experienced many incidents of gun violence, in which bullets fired from firearms or other ballistic projectiles, have killed and injured people. Examples of this have included shootings in schools, churches, and corporate offices, where active shooters have killed and injured many innocent victims. Moreover, explosives including pipe bombs, pressure-cooker bombs, and so on, containing nails, ball bearings, and other shrapnel have caused similar injuries. Accordingly, there has been a growing demand for non-lethal protection by the everyday citizen at work, play or in the comfort of their home.

Year after year, terrorist and domestic dispute events have occurred that warrant safe, inconspicuous, non-lethal protection that prepare public institutions, government agencies, businesses and homes with protection against such events or an "active shooter".

Schools, businesses, corporate offices, and other organizations have taken steps to harden their facilities to various threats. Some have procedures in place for responding to active shooters and bomb threats, and many even have practice drills. However, most of these preparations are insufficient to truly alleviate and address the problem. Due to the nature of these incidents, innocent bystanders are likely still exposed to the potential of serious harm by these threats with little protection. In some cases, hardening offices and school rooms to provide ballistic protection has not been possible or has been limited to a large extent. For example, in some cases, the possibility of introducing ballistic armaments to facilities has been met with concerns of eliciting undue fear and apprehension in school children, patients, and/or employees. Consequently, prominently locating protective tactical gear or related armored safety equipment is not an option in many environments.

Accordingly, there is a need for concealable ballistic protection for persons that can be readily accessible in facilities which are potential targets for individuals wishing to do harm with ballistic projectiles, firearms, or explosives without negatively impacting those environments.

SUMMARY

Embodiments described or otherwise contemplated herein are generally directed to ballistic art shields that provide a concealable ballistic armament that is readily accessible for use by individuals to defend against attacks of dangerous or lethal force. These armaments can be concealed behind, or within, common wall-hung office, school, or workplace décor such as artwork and related signage that would ordinarily be located in these facilities. Disguised works of art, posters, banners, wall-hangings, signs, signboards, pictures, paintings, advertisements, announcement boards and billboards are some of the types of articles contemplated by this disclosure.

An embodiment is directed to a concealed ballistic art shield. The ballistic art shield includes an outwardly-facing surface, an inwardly-facing surface, and a ballistic resistant material. The outwardly-facing surface has a generally planar configuration and the inwardly-facing surface is oriented in an opposing direction to the outwardly-facing surface. The inwardly-facing surface has a generally planar configuration and includes at least one handle that is adjustable to a low profile position with respect to the inwardly-facing surface. The ballistic resistant material is disposed between the outwardly-facing surface and the inwardly facing surface. The outwardly-facing surface includes a shroud for concealing the ballistic resistant material and has a disguised appearance resembling a wall-hung interior wall décor item.

An embodiment is directed to a concealed ballistic art shield. The concealed ballistic art shield includes a ballistic resistant material, a frame and wall décor assembly, and an interior panel. The ballistic resistant material includes an outwardly-facing planar surface and an inwardly facing surface oriented in opposing directions. The frame and wall décor assembly extends over and around the outwardly-facing planar surface of the ballistic resistant material such that the ballistic resistant material is concealed. The interior panel extends at least partially over the inwardly facing planar surface of the ballistic resistant material. Further, the interior panel includes a wall mounting structure and at least one handle adjustable to a low profile position against or recessed within a portion of the interior panel.

An embodiment is directed to a concealed ballistic art shield. The concealed ballistic art shield includes a ballistic resistant material and an interior panel. The ballistic resistant material includes an outwardly-facing planar surface and an inwardly facing planar surface oriented in opposing directions. The ballistic resistant material is sized for insertion within an interior perimeter of a standard sized wall-hung picture frame. The interior panel is coupled to the inwardly facing planar surface of the ballistic resistant material. The interior panel contains a plurality of flanges that extend outwardly beyond the perimeter of the ballistic resistant material and provide attachment locations for mounting the interior panel to a standard sized wall-hung picture frame. The interior panel includes at least one handle that is adjustable to a low profile position against or within a portion of the interior panel.

Embodiments include a camouflaged or decorated ballistic resistant (i.e. bullet-proof or shrapnel proof) art shield capable of providing full or partial body protection consisting a square, rectangle, circle, oval, other shaped frame or object used to depict art or other informative signage hung or mounted on a wall. A ballistic resistant (i.e. bullet-proof or shrapnel proof) material is mounted to the frame. Some embodiments can include a hand held part on the back of the frame. In some embodiments, the frame can withstand ballistic impacts and retain the frame shape. Embodiments provide a non-lethal means of protection from a bullet fired or shrapnel from gun or explosive, which is in front of the user of the shield. The ballistic resistant (i.e. bullet-proof or shrapnel proof) wall hanging is designed to apply any art form to the face of the unit thereby concealing its dual intended use.

Embodiments can physically protect an individual or multiple individuals using a ballistic material disguised as art, signage, or a promotional product, for example. The concealed nature affords protection while keeping with the look of the existing environment. This can include embodiments that blend with the décor or theme of the institution or event. Embodiments can provide the holder with needed protection when first being approached by a shooter, or once alerted that a shooter has been identified. In these circumstances, a holder can remove the art from the wall or location and have protection against a shooter.

Some embodiments of ballistic art can consist of a ballistic resistant material in the form of a panel mounted to an existing frame or a new frame. The frame can be made of wood, plastic, carbon fiber, metal or other sturdy composite material. The ballistic panel can be mounted or adhered to the frame, and the user can canvas, cover, disguise or Obfuscate the ballistic panel with completed art work, production prints, art mask, wayfinding signage, paint, cloth, ballistic fabric or general information. In some embodiments, mounting can include wrapped-over, tucked, pressed, crimped, screwed, nailed, glued or framed attachment. Sizing can be based on application to existing art, new art or a physical environment. In some embodiments, this resulting combination can then be hung or mounted. In other embodiments, the combination can be propped, braced, collapsed, popped-up, folded or made to standalone. In some embodiments, ballistic art framing can include a lattice-style backing to provide additional shock protection during attack and to aid in energy absorption.

In some embodiments, ballistic art shields can be equipped for clasping. Clasping allows multiple devices to be joined such that greater protection is created. In these embodiments, the individual shields can be joined via multiple facets. This can be done by abutting the shields with magnets, clasps, overlapping structures, extendable structures, slide out structures, or hinges.

Embodiments can be connected with communications capabilities. This can include wired or wireless components enabling an Internet of Things (IoT) mode or communications with an existing security system. Accordingly, when the shield is disturbed, removed or used, it can trigger an alert to a supporting security system, mobile application and/or the authorities of an attack underway. This prompt communication can minimize the time necessary for authorities to arrive. Faster response times by first responders are possible based on the early alerts provided by this type of connectivity/messaging.

In some embodiments, ballistic art framing can include a handle or pair of handles that a user can use to hold the ballistic art when in a defensive or offensive posture, thus repelling the attacker or threat projectiles. In some embodiments, ballistic art framing can include a handle that supports two hands. This can be useful for defensive posturing or for carrying during flight from a scene while providing protection. In addition, embodiments can include a knee touchpoint pad that enables additional support on one or more of the legs of the carrier, such that the embodiment keeps corners intact during an attack.

In various embodiments, when ballistic art is produced, it can be constructed of a premade size, made to order size, or provided as a do-it-yourself kit. The ballistic resistant material is generally comprised of rigid panels, flexible sheets or panels, woven materials, laminates, and combinations thereof. For example, Kevlar® aramid fiber and similar products are currently used to manufacture ballistic vests for law enforcement personnel. Other materials known to those skilled in the ballistic arts include UHMWPE (Ultra-high-molecular-weight polyethylene), polycarbonates like Lexan, and carbon fiber composite materials, for example. In some fabrics, interstitially synthesized nanotubes, such as single-walled or multi-walled carbon nanotubes can be used.

Ballistic art can be placed in plain view where specifically trained or informed persons can utilize it in the event of an incident in their vicinity. The ballistic art can be made available to schools, corporate offices, hospitals, embassies, banks, lobbies, waiting rooms and personal homes where ballistic defenses are required or desired. In many cases, this type of defensive, non-lethal equipment is safer than a more offensive solution. The product works to protect persons in public settings such as school children, teachers, lobby attendants, entry way staff, public servants and others, who might be exposed to the unsecured members of the general public in locations where active shooter, terrorist or other domestic disturbances are known to occur.

In some embodiments, the ballistic art can consist of portable or fixed collapsible signage that is easily set-up for events, entry way guidance, or public information. The underlayment of a ballistic resistant material panel allows the signage to quickly serve as protection to a nearby person by getting behind, tipping over, or covering under the structure. Embodiments can be mobile in nature so that a person may flee. Some embodiments can include an embedded hood for a person to view the way out of the scene without additional exposure.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
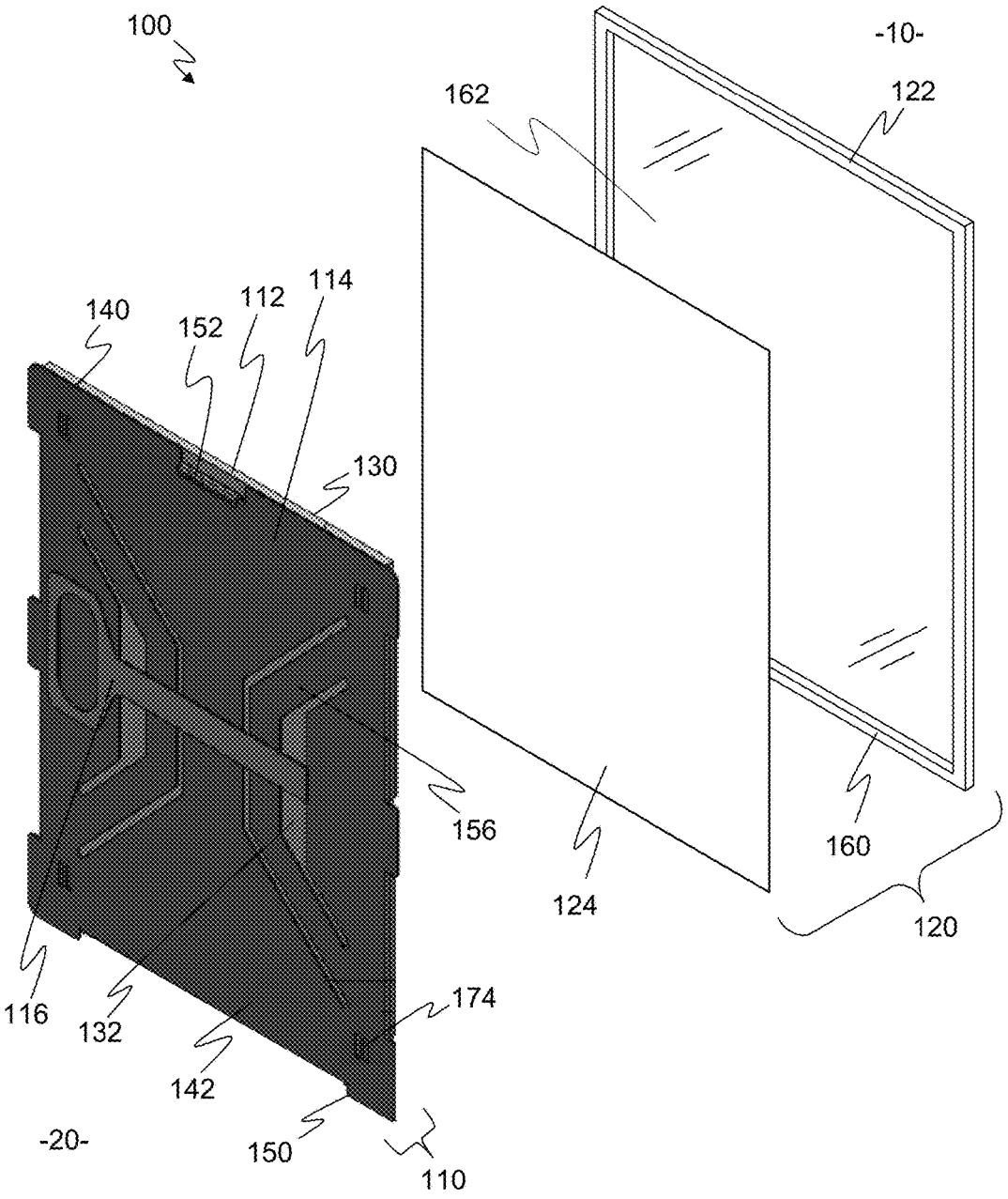
FIG. 1 is a perspective view of a partially exploded view of a concealed ballistic art shield, according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

FIG. 1 generally shows an embodiment of a concealed ballistic art shield 100 in a partially exploded perspective view. The concealed ballistic art shield 100 includes a protection assembly 110 comprising a ballistic resistant material 112, interior panel 114, and release pin 116. The concealed ballistic art shield 100 further includes a frame and wall décor assembly 120 comprising a frame 122 and an interior wall décor item 124. Accordingly, when combined, the protection assembly 110 and frame and wall décor assembly 120 align into coupled engagement with one another to form a concealed ballistic art shield 100 that is mountable, low profile, and has the disguised appearance of an everyday wall hanging.

As a general frame of reference for purposes of this application, the area directly in front of a wall hung concealed ballistic art shield 100, where one would typically view artwork, signage, or other décor item, will be considered its outward side, as labeled at numeral 10. Conversely, the area directly behind the wall hung concealed ballistic art shield 100 proximate the location where the shield would be mounted on the wall is deemed the inward side, as labeled at numeral 20.

Figure 2:
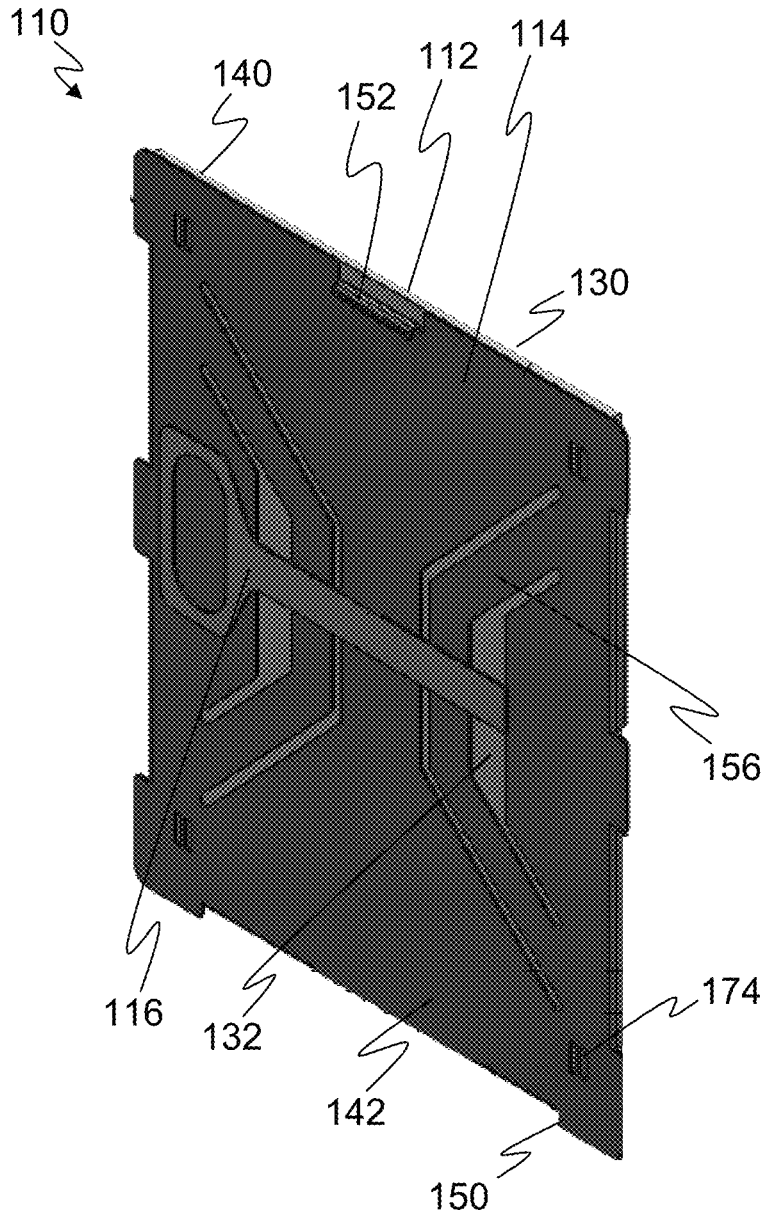
FIG. 2 is a perspective view of a protection assembly of a concealed ballistic art shield, according to an embodiment.
Figure 3:
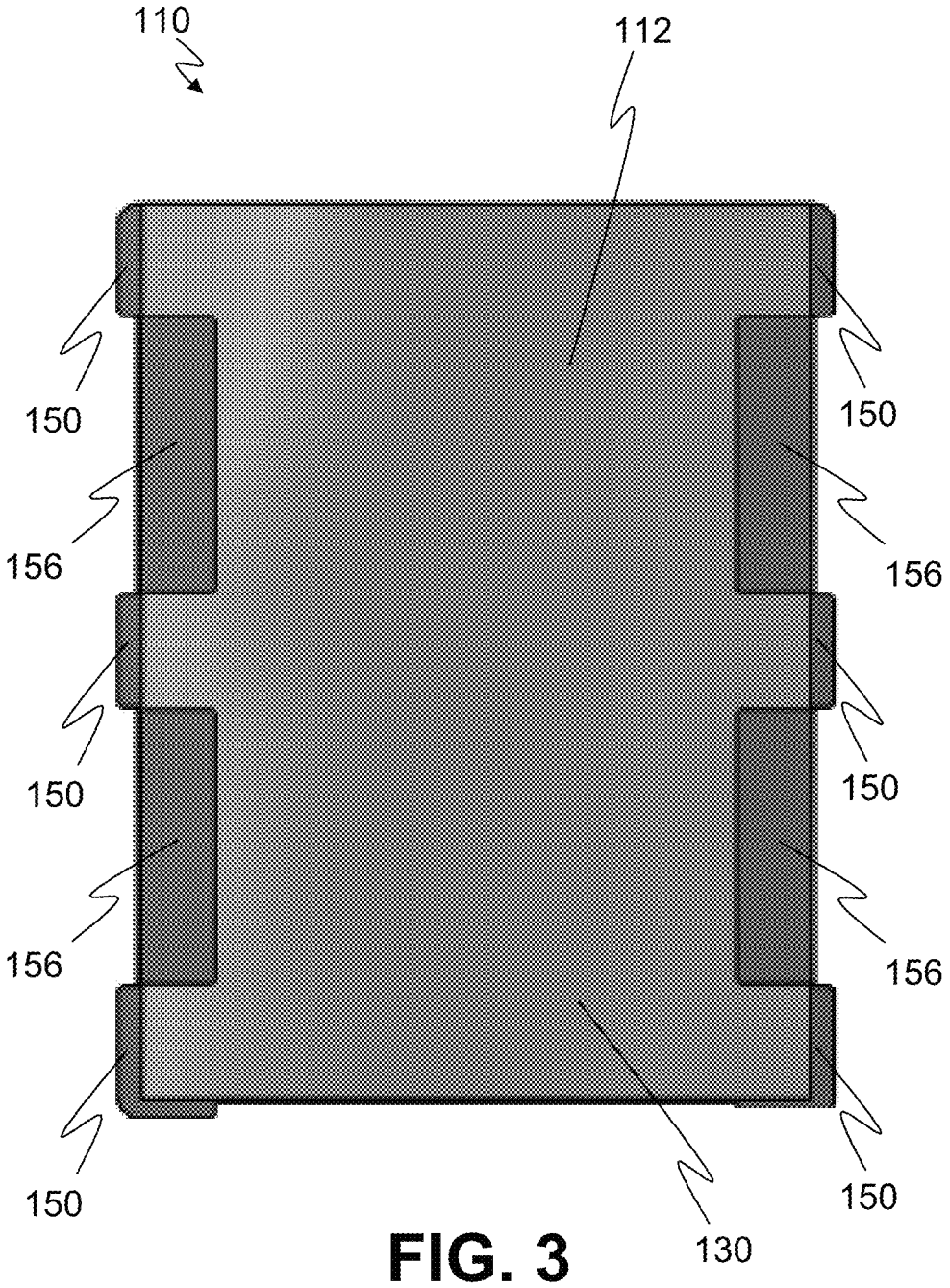
FIG. 3 is a front view of the protection assembly of a concealed ballistic art shield, according to an embodiment.
Figure 4:
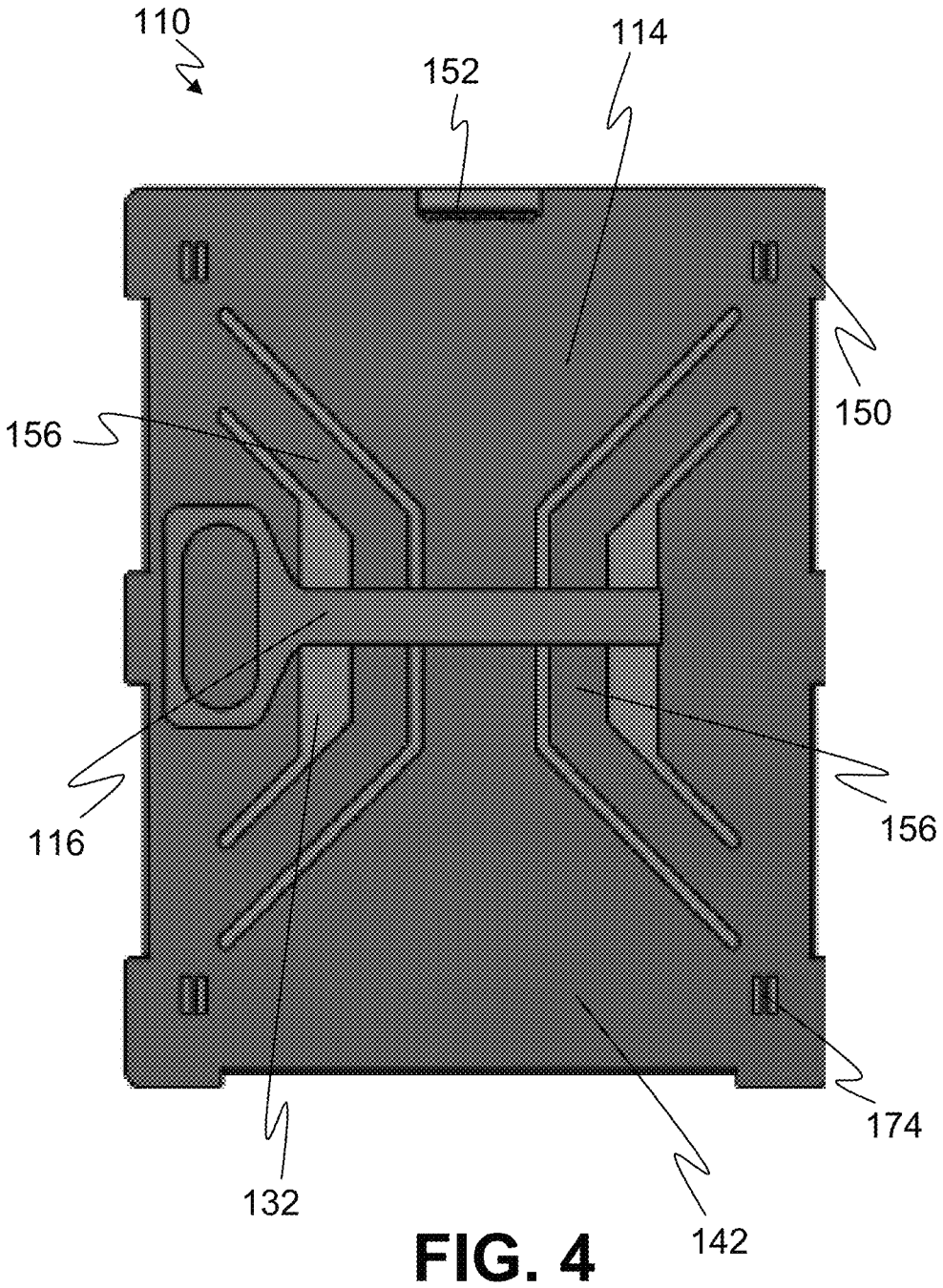
FIG. 4 is a rear view of the protection assembly of a concealed ballistic art shield, according to an embodiment.
Figure 5A:
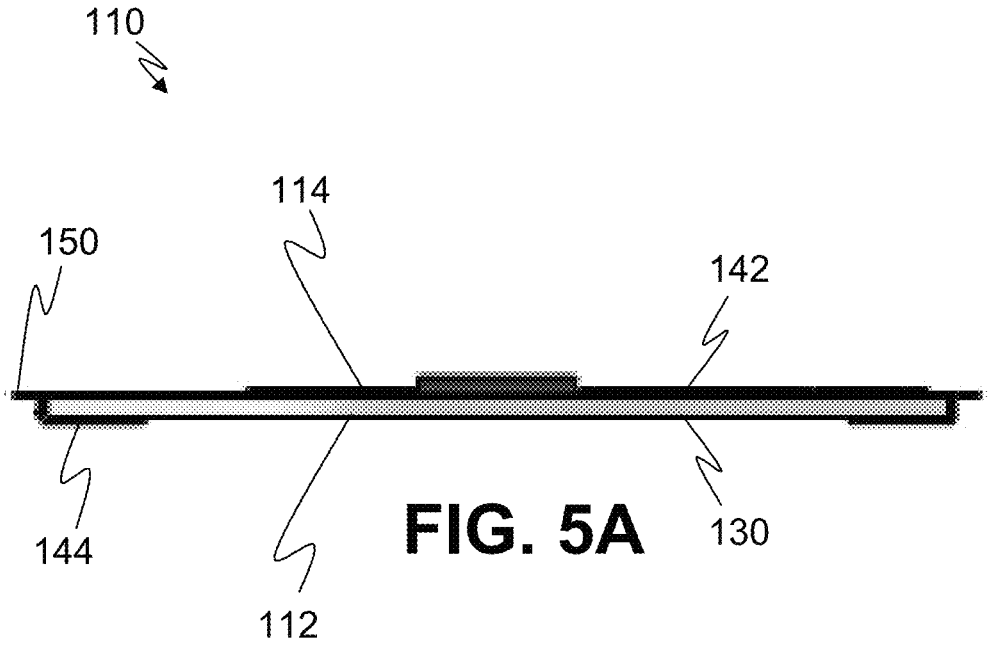
FIG. 5A is a top view of the protection assembly of a concealed ballistic art shield with handles in a low profile position, according to an embodiment.
Figure 5B:
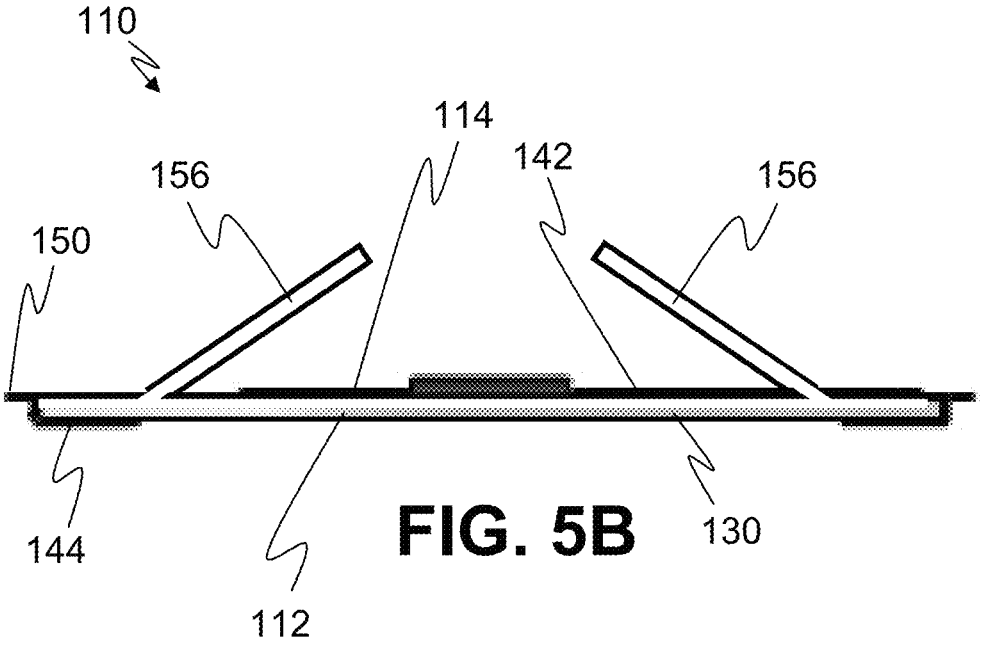
FIG. 5B is a top view of the protection assembly of a concealed ballistic art shield with handles in a deployed position, according to an embodiment.
Figure 6A:
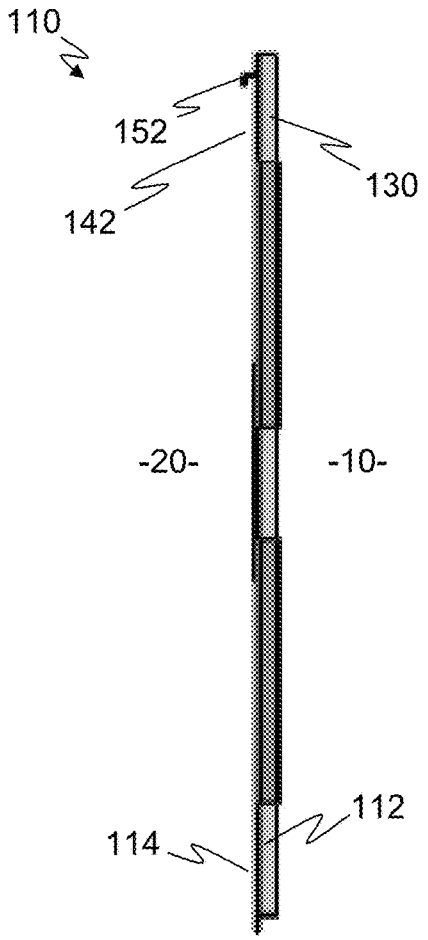
FIG. 6A is a side view of the protection assembly of a concealed ballistic art shield with handles in a low profile position, according to an embodiment.
Figure 6B:
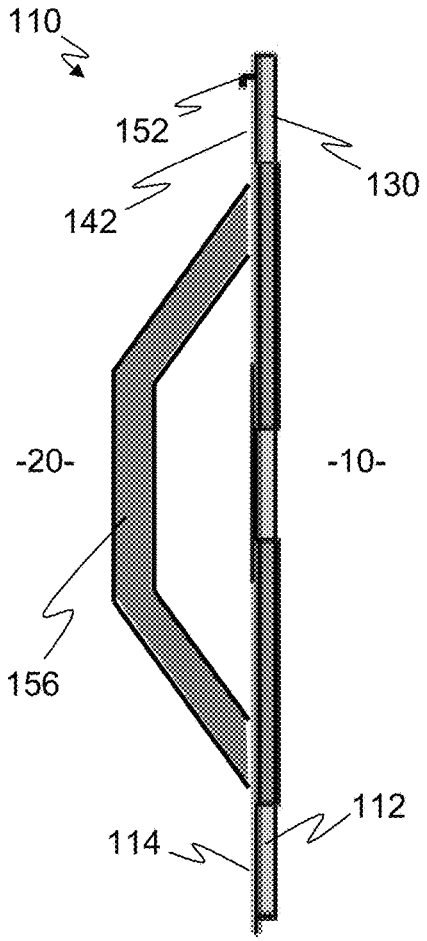
FIG. 6B is a side view of the protection assembly of a concealed ballistic art shield with handles in a deployed position, according to an embodiment.
Figure 7:
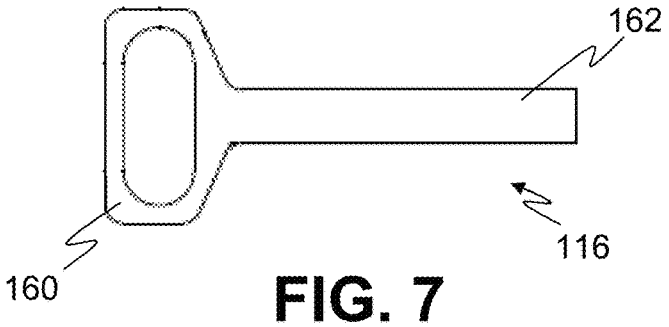
FIG. 7 is a quick release pin for a concealed ballistic art shield, according to an embodiment.
Figure 8:
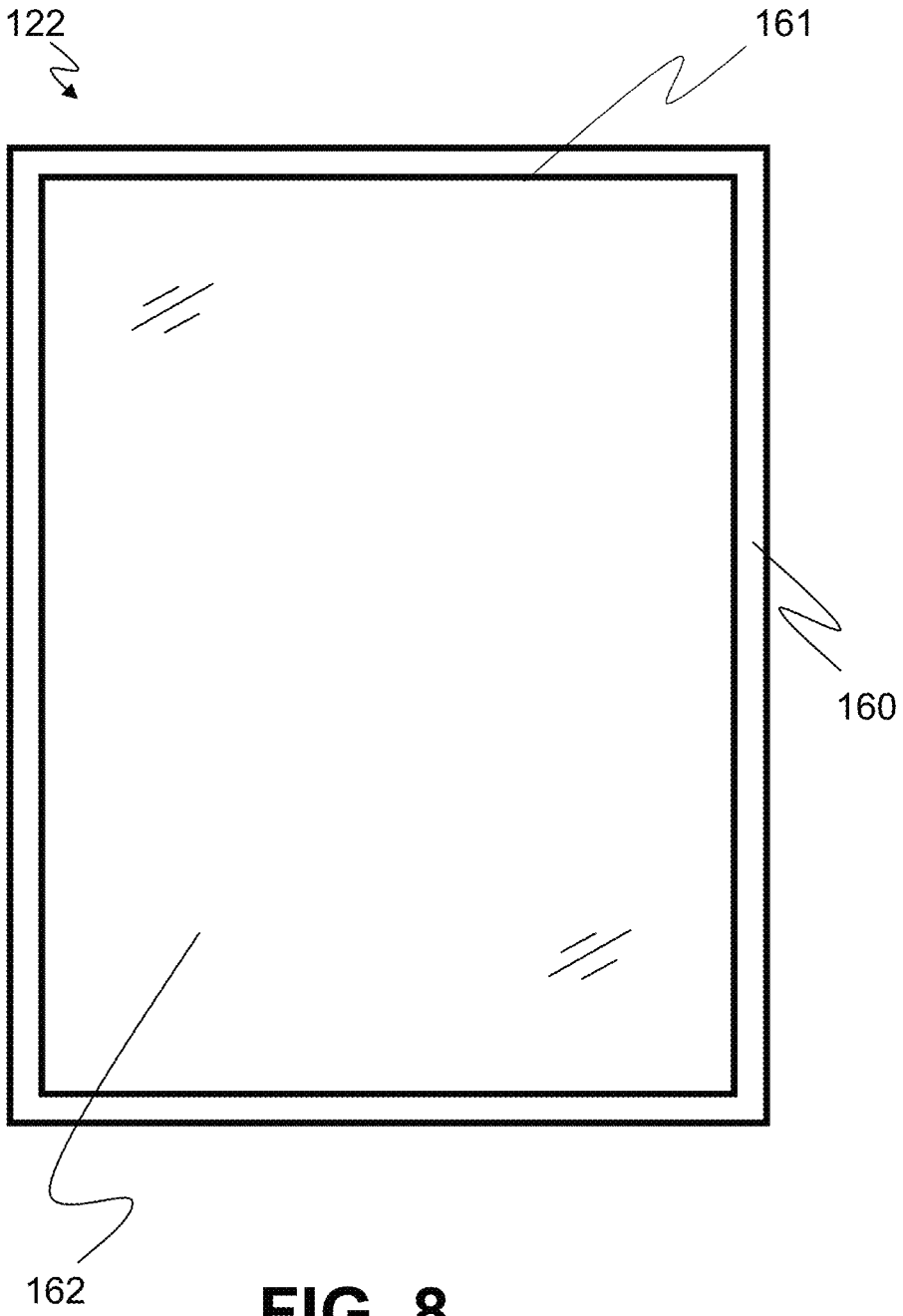
FIG. 8 is a front view of a frame of a concealed ballistic art shield, according to an embodiment.
Figure 9:
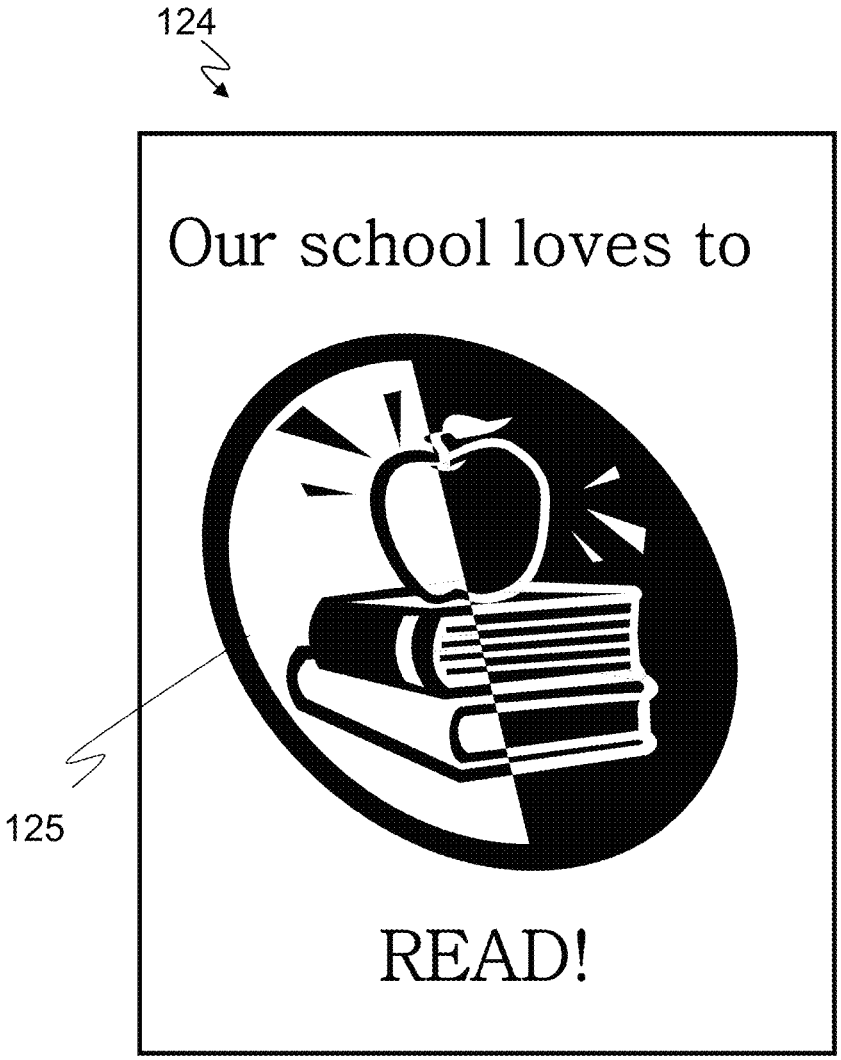
FIG. 9 is a front view of an interior wall décor item of a concealed ballistic art shield, according to an embodiment.

In addition to FIG. 1, further FIGS. 2-9 also show the features of concealed ballistic art shield 100 individually or in combination, in greater detail, and can be collectively referenced with respect to the below discussion. Specifically, FIG. 2 shows a perspective view of protection assembly 110, FIG. 3 provides a front view of protection assembly 110, FIG. 4 shows a rear view of the protection assembly 110, FIGS. 5A and 5B provide top views of the protection assembly 110, FIGS. 6A and 6B show side views of the protection assembly 110, FIG. 7 shows quick release pin 116, FIG. 8 shows a front view of frame 122, and FIG. 9 provides a front view of an example of an interior wall décor item 124.

Protection assembly 110 is generally shown to include both a ballistic resistant material 112 and interior panel 114 coupled with one another. Protection assembly 110 defines a generally rectangular shape overall in the figures. However, any number of additional shapes could be utilized as well. For example, oval, circle, square, triangular, polygon or non-uniform shapes could be used in some embodiments. As shown in FIGS. 1-4, ballistic resistant material 112 has a generally planar configuration that largely comprises two primary surfaces. Namely, an outwardly-facing surface 130 and an inwardly-facing surface 132. Much of outwardly-facing surface 130 can be seen in FIG. 3, although most of inwardly-facing surface 132 is obstructed by from view by interior panel 114 in the figures. Both outwardly-facing surface 130 and an inwardly-facing surface 132 are generally flat and planar in overall shape.

Ballistic resistant material 112 is generally a rigid panel or flexible sheet of material including woven materials, laminates, and combinations thereof. In some embodiments, Kevlar® aramid fiber, polyethylene fibers such as SPECTRA SHIELD®, and similar products are used as ballistic resistant material 112. Further, ballistic-resistant materials 112 can include other materials like UHMWPE (Ultra-high-molecular-weight polyethylene), a polycarbonate like Lexan, or carbon fiber composite materials. In some fabrics, interstitially synthesized nanotubes, such as single-walled or multi-walled carbon nanotubes can be used. In some embodiments, the ballistic resistant material 112 can be selected from the group consisting of: boron carbide, silicon carbide, silicon nitride, aluminum oxide, alumina ceramic, titanium diboride, reinforced fiberglass composite, and mixtures of such materials. In some embodiments, the ballistic resistant material 112 can include bullet proof glass or a polycarbonate polymer. Although other structures can additionally aid in shielding a user from ballistic dangers, the ballistic resistant material 112 generally serves as the protection structure for a user of the concealed ballistic art shield 100. For purposes of this application, "ballistic end resistant material" should be broadly construed to include all relevant lightweight armament protection materials.

As shown in FIGS. 1-4, interior panel 114 is depicted with a generally planar configuration that largely comprises two primary opposing surfaces. Namely, an outwardly-facing surface 140 and an inwardly-facing surface 142. Inwardly-facing surface 142 can be seen in FIGS. 1, 2 and 4. Outwardly-facing surface 140 is generally covered from view by ballistic resistant material 112 in the figures. Both outwardly-facing surface 140 and an inwardly-facing surface 142 are generally flat and planar in overall shape. Interior panel 114 is generally comprised of metal or other rigid material. In some embodiments, interior panel may be formed of reinforced plastic or other dense material.

In protection assembly 110, inwardly-facing surface 132 of ballistic resistant material 112 and outwardly-facing surface 140 of interior panel 114 are largely disposed in opposite directions, such that they are directly adjacent one another and are held together in coupled engagement. In some embodiments, as shown in FIG. 3, inwardly-facing surface 132 of the ballistic resistant material 112 and outwardly-facing surface 140 of the interior panel 114 are held together by retaining members 144 of the interior panel 114.

Specifically, four retaining members 144 are shown which comprise tabs of material from the interior panel 114 which have been bent back 180 degrees to partially surround and retain the edges of the ballistic resistant material 112 in place. In other embodiments, inwardly-facing surface 132 of the ballistic resistant material 112 and outwardly-facing surface 140 of the interior panel 114 are coupled together additionally or independently by fasteners or an adhesive or other bonding substance.

Also shown on interior panel 114 are a plurality of flanges 150 at spaced apart locations around its perimeter. See FIGS. 1-4, for example. In general these flanges 150 extend outwardly beyond the perimeter of the ballistic resistant material 112. Flanges 150 can extend from any number of locations, including but not limited to, the sides, corners, tops and bottom perimeter of the interior panel 114. These flanges 150 can provide attachment locations for mounting the interior panel 114 to a frame 122, such as a standard sized wall-hung picture frame. In some embodiments, apertures (not shown) may be located in flanges 150 for insertion of screws or other fasteners.

As seen in FIG. 1, interior panel 114 further includes a wall mounting structure 152 on its inwardly-facing surface 142. This wall mounting structure 152 may comprise a short inwardly extending flange of material bent back from the generally planar surface of the interior panel 130 or any other type of feature upon which the concealed ballistic art shield 100 can be mounted or hung. In some embodiments, a wall mounting structure 152 can include a wire or string mounted across the interior panel. In some embodiments, a wall mounting structure 152 can include hooks, apertures, magnets or adhesive components.

Additionally, interior panel 114 further includes handles 156. In the embodiments shown in FIG. 1 a pair of handles 156 is shown. Some embodiments can include a single handle 156 or more than two handles 156 as well. In general, handles 156 are adjustable to a low profile position with respect to the inwardly-facing surface 132 of the interior panel 114. In some embodiments, handle(s) 156 are configured to recess against or within the inwardly-facing surface 132. In some embodiments, this refers to the handle(s) 156 being adjustable to a low profile position against or recessed within a portion of the interior panel 114. The handles 156 shown in FIG. 1 are formed from recesses or cuts into the interior panel 114 that define two angled arch-shaped handle features 156. A deformed bend is applied to the resulting defined handles 156 such that they are biased to project in an inward disposition. A release pin 116 is located across these handles 156 to retain the handles 156 and resist their biased state, such that the handles 156 stay in a low profile position with respect to the planar inwardly facing surface 142 of the interior panel 114. Accordingly, the handles 156 can be viewed as pin-activated, quick release handles 156 because the handles 156 are thrust into a deployed state by a user merely removing release pin 116.

Figure 10:
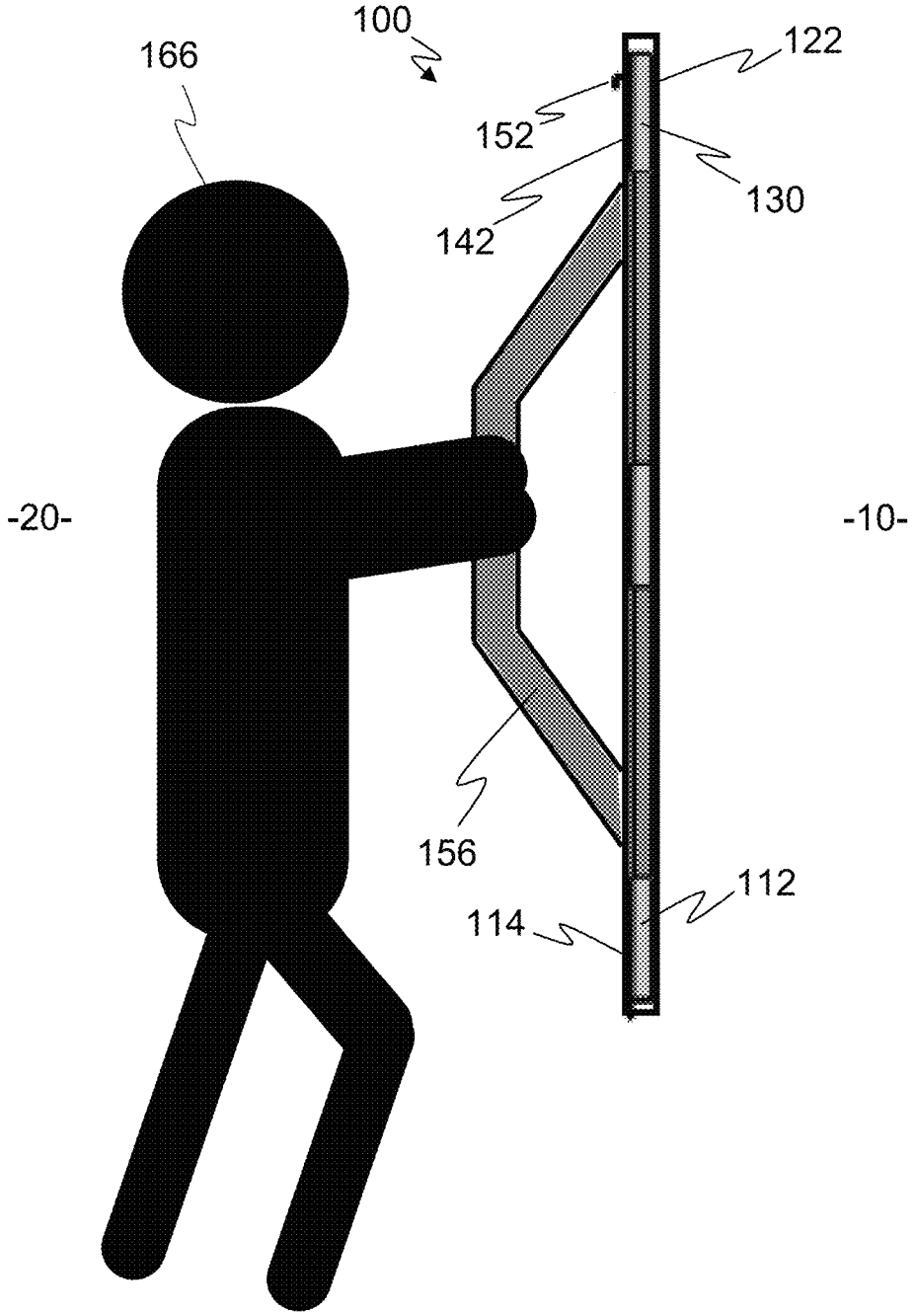
FIG. 10 is a side view of an individual using a concealed ballistic art shield with handles deployed from a low profile position to an extended position, according to an embodiment.

In some embodiments, handles 156 are separately hinged or otherwise attached to the planar inwardly facing surface 142 of the interior panel 114. In some embodiments, handles 156 are folded into a low profile position and are not biased. Some handles 156 are considered to have a tension spring loaded bend. Other biased or spring loaded arrangements are contemplated as well. Handles 156 may be generally vertically oriented and supported at multiple locations, as shown in FIGS. 3, 6B and 10, for example. Handles 156 may be horizontally disposed and supported in some embodiments as well. A variety of differently shaped and oriented handles 156 are contemplated with various reinforcement and support arrangements. See FIGS. 15 and 16 for example.

FIGS. 5A and 6A show top and side views, respectively, of the handles 156 retained in a low profile, recessed arrangement within the confines of the other portion of the interior panel 114 and protection assembly 110 generally. This provides a relatively flat and planar surface on interior panel 114 for mounting to a wall. Alternatively, FIGS. 5B and 6B show top and side views, respectively, of the handles 156 extending to a biased, inwardly extending position. In this particular example, the handles 156 are biased to extend at a converging, angled orientation, as viewed from above. In some embodiments the handles will converge inwardly at +/−thirty to sixty degree angles, as viewed from above. In this arrangement, the handle grips are located centrally to the torso of a user when held, such that a strong defensive posture can be achieved. See also FIG. 10, for example.

Release pin 116, as shown in FIG. 7, includes a looped handle portion 160 and an elongate interference portion 162. Other easy grip-and-remove structures are possible as well. In some embodiments, the release pin 116 will be slid over the biased central grip portions of the handles 156 and underneath or in a retained arrangement against one or more features of interior panel 114. Other types of retaining components for quick release handles 156 are possible as well, such as latches, knobs, buttons, etc. The retained and low profile arrangement of the handles 156 allow the ballistic art shield 100 to be appropriately disguised as a piece of wall-hung décor such as a poster, signage, or other item.

One benefit of the release pin arrangement of FIG. 1 is that the handles 156 are thrust into the active and ready to use position once deployed. This can spur a user into action and places the handles 156 at a default position that is pertinent to a defensive shielding posture. In some embodiments, removal of the release pin 116 can be tied to law enforcement notification. For example, pulling the release pin 116 could trigger a sensor and transmit a silent alarm to authorities to make them aware of a threat and provide information regarding the fact that a shield 100 at a particular location was being used. This type of alarm and notification could be carried out by any number of existing sensors and wired or wireless communication technologies. Similarly, a similar optical, motion, magnetic or force sensor or alarm could be otherwise associated with and operate based on motion or activities of the ballistic art shield 100 as well. Some embodiments could include audio or visual elements associated with the shields 100, such as cameras and speakers that could transmit data and information about an attack to law enforcement. Hardware such as processors, memory, communications circuitry and modules can be incorporated.

As shown separately in FIG. 8, frame 122 can include any number of types of general frames for pictures, photographs, paintings, signage or other types of artwork or wall décor items 124. Frame 122 can be a standard size, readily available wall-hung picture frame. Examples of sizes for such frames can include: 18 inches by 24 inches; 20 inches by 20 inches; 18 inches by 20 inches; and many others. Standard size wall-hung picture frames should include frames of any commonly sold picture frame size. In general, embodiments can utilize an existing frame or a new frame 122. The perimeter 160 of frame 122 can be made of wood, plastic, carbon fiber, metal or other sturdy composite material. The perimeter 160 of frame 122 defines an interior perimeter 161 in which appropriately-sized wall décor items 124 can fit. In some embodiments, the perimeter 160 of the frame 122 itself can be made of ballistic resistant material.

In some embodiments, frames 122 will include centrally-located, transparent material 162, such as glass or plastic, through which the artwork or interior wall décor item 124 can be viewed. Transparent material 162 can be made of tempered glass, safety glass, or other materials that does not break in a dangerous manner.

In FIG. 9, an example of a poster that could serve as an interior wall décor item 124 in a school or similar facility is shown. In general, an interior wall décor item 124 can be any wall-hung office, school, or workplace décor such as artwork and related signage that would ordinarily be located in these facilities. In FIG. 9, an example of a school poster with a message and graphic 125 is depicted. An interior wall décor item 124 could include, but is not limited to, works of art, banners, wall-hangings, signs, signboards, pictures, paintings, graphics, advertisements, promotional materials, announcement boards, or similar item referred to in this application.

An interior wall décor item 124 can be first mounted to the outwardly facing surface 130 of the protection assembly, an intermediate lightweight mortarboard (not shown), or initially to the frame 122. In certain embodiments, the interior wall décor item 124 is mounted or adhered to the frame 122. In certain embodiments, the user may canvas, cover, disguise or obfuscate the ballistic panel with an interior wall décor item 124, such as a completed art work, production prints, art mask, wayfinding signage, paint, cloth, ballistic fabric or general information. In some embodiments, mounting can include wrapped-over, tucked, pressed, crimped, screwed, nailed, glued or framed attachment. Sizing can be based on application to existing art, new art or a physical environment.

In various embodiments, the ballistic resistant material 112, interior panel 114, frame 122 and interior wall décor item 124 can be readily aligned, combined, and coupled into a complete concealed ballistic art shield 100. The resulting combination, comprising a concealed ballistic art shield 100, can be hung, mounted, braced, popped-up, or otherwise secured to a wall. The appearance of the concealed ballistic art shield 100 in this context, from outward side 10, will merely be that of a framed and mounted interior wall décor item 124. In some embodiments, a concealed ballistic art shield 100 may refer to only the ballistic resistant material 112, interior panel 114, and interior wall décor item 124 in combination, and not necessarily include a frame 122. In some embodiments, a concealed ballistic art shield 100 may refer to only the ballistic resistant material 112 and interior panel 114 in combination, and not necessarily specifically include interior wall décor item 124 or frame 122. Other configurations may satisfy this shield as well. References to concealed ballistic art shield 100 should be interpreted broadly throughout this specification and claims.

In some embodiments, the outwardly facing surface of a concealed ballistic art shield 100 will be considered a shroud that conceals the ballistic resistant material and resembles a wall-hung interior wall décor item. In some embodiments, this shroud refers to the frame and wall décor assembly 120. In some embodiments, this shroud refers to the interior wall décor item 124 itself. In some embodiments, this shroud refers to a frame 122.

At times throughout this disclosure, outwardly-facing surfaces (such as surfaces 130 and 140) and inwardly-facing surfaces (such as surfaces 132 and 142), ballistic resistant material 112, interior panel 114, protection assembly 110, frame and wall décor assembly 120, frame 122, interior wall décor item 124, concealed ballistic art shield 100 or various components and combinations of components refer to being "planar", "generally planar", or a having a "generally planar configuration". These terms should not be interpreted broadly and not in an overly stringent way geometrically. Such terms are intended to convey the primary shape of such surfaces or features not strict adherence to them. Likewise, surfaces or handles 156 which are referred to as having a "low profile" position against or with respect to a surface, should not interpreted in an overly narrow manner and only require a nearly or entirely flush configuration to be deemed low profile.

The overall dimensions of the concealed ballistic art shield 100 can vary significantly based upon application. For example, in some embodiments, the thickness of the shield 100 will be 1.0 inch or less. In some embodiments, the thickness of the shield 100 will be 0.5 inches or less. In some embodiments, the thickness of the shield 100 will be between 0.25 inches and 1.5 inches. In some embodiments, the thickness of the shield 100 will be less than 2.0 inches. Certain embodiments and applications require greater depth/thickness to meet the desired safety tolerances of ever increasing ballistic calibers and explosive strengths.

In some embodiments, inwardly extending protrusions from the interior panel 114 and inwardly-facing surface 142 will be limited in dimension. These limited protrusions aid in supplying significant concealment and disguise of the shield 100 such that it is consistent with typical items of wall décor. In some embodiments, protrusions are dimensioned so as not exceed 1.0 inch from the frame 122 of a given interior wall décor item 124. In some embodiments, handles 156 will be partially recessed and will project slightly from the inwardly-facing surface 142. For example, in some embodiments, handles 156 or other inwardly extending protrusions will project 0.25 to 0.5 inches from inwardly-facing surface 142 when configured in an undeployed, low-profile configuration suitable for wall-hanging. In some embodiments, protrusions of the shield 100 will extend less than 0.5 inches. In some embodiments, protrusions will extend less than 1.0 inches. In some embodiments, handles 156 will be fully recessed and will not project outwardly from the inwardly-facing surface 142.

The embodiment of FIG. 10 provides a side view of an individual 166 using a concealed ballistic art shield 100 with handles 156 deployed from a low profile position to an extended position. In general, the size and shape of the shield 100 and handles 156 can vary to best accommodate the appropriate décor for a given environment and size ballistic shield that would be considered most useful or effective for that environment. In most embodiments, the concealed ballistic art shield 100 functions merely as a tool for non-lethal passive defensive measures. In some embodiments, however, the concealed ballistic art shield 100 could be utilized as a weapon. Embodiments can further include modifications or structural reinforcements such that it could be better utilized for offensive attacking.

Figure 11A:
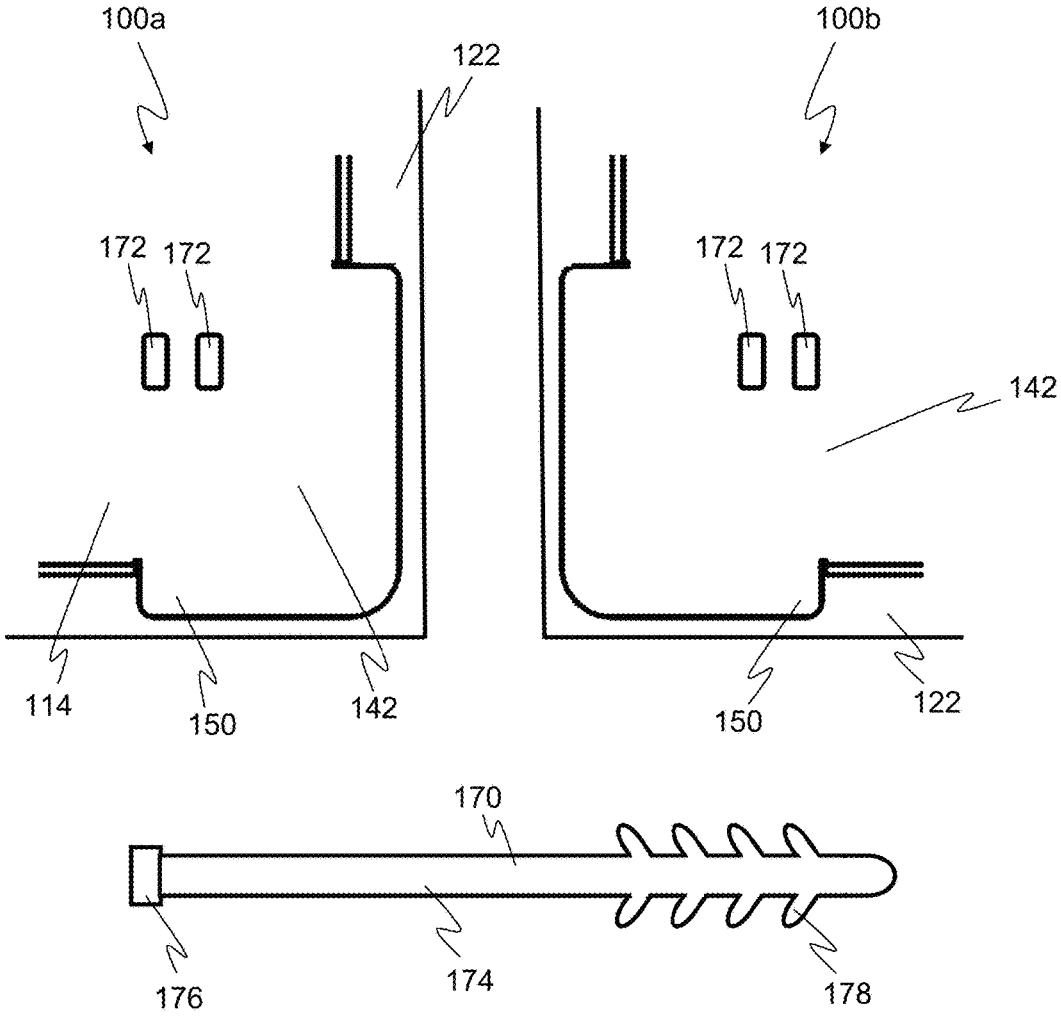
FIG. 11A is partial rear view of two concealed ballistic art shields adjacent to one another and an unused tensile strap connector, according to an embodiment.
Figure 11B:
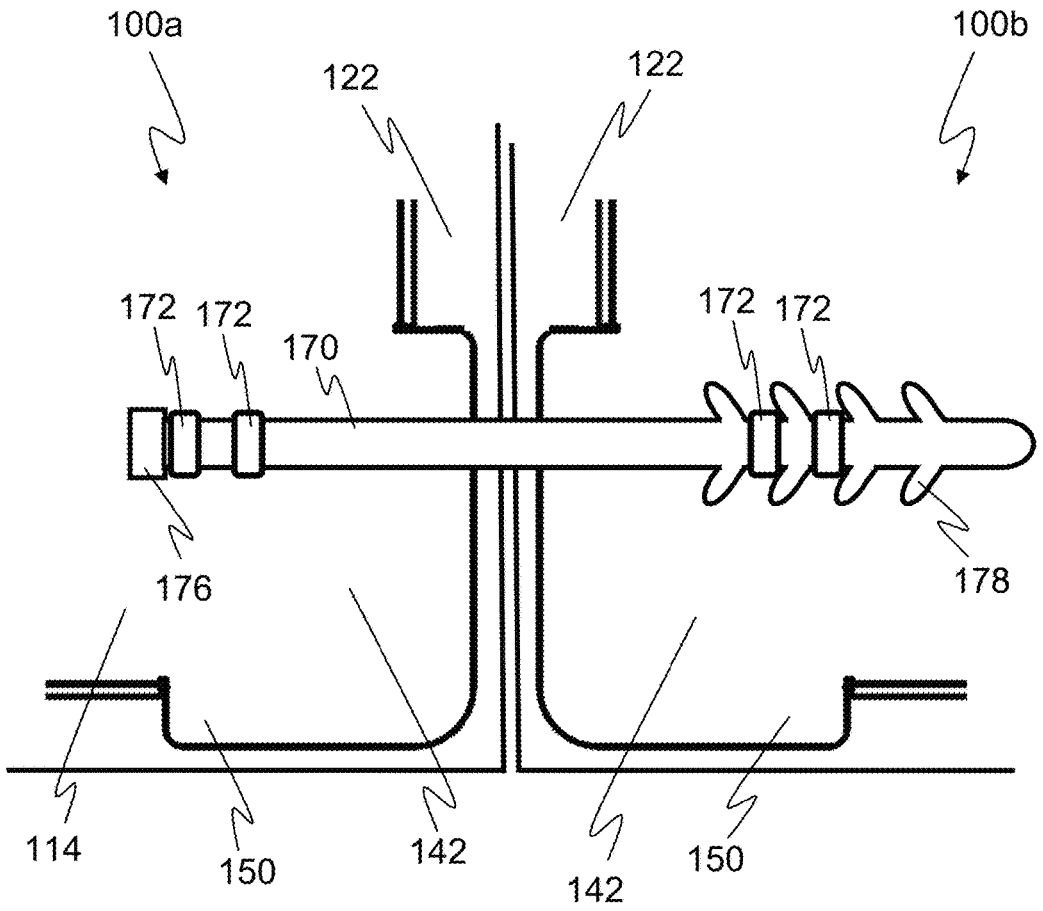
FIG. 11B is partial rear view of two concealed ballistic art shields adjacent to one another that are connected via a tensile strap connector, according to an embodiment.
Figure 11C:
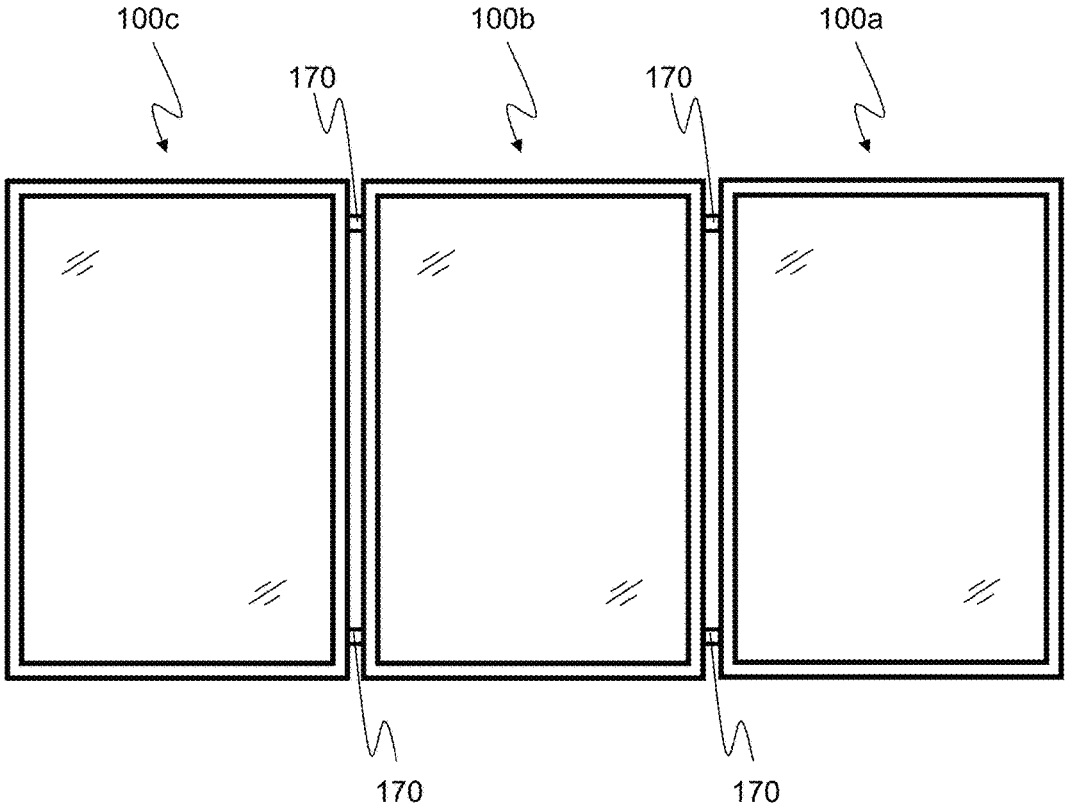
FIG. 11C is front view of three concealed ballistic art shields connected adjacent to one another via tensile strap connectors, according to an embodiment.

FIGS. 11A-C generally illustrate the clasping feature that can be included in various concealed ballistic art shield embodiments. FIG. 11A is partial rear view two concealed ballistic art shields 100*a* and 100*b* adjacent to one another and an unused tether, referred to as a tensile strap connector 170, according to an embodiment. In general, the lower right corner of ballistic art shield 100*a* is shown and the lower left corner of ballistic art shields 100*b* is shown. Each shield depicts a frame 122 and inwardly facing surface 142 of the interior panel 114 including flanges 150. Further, shown on inwardly facing surface 142 are a set of shield sleeve supports 172. These shield sleeve supports 172 may be raised arches, as generally depicted in FIGS. 11A and 11B, providing a raised arch containing an open aperture. Shield sleeve supports 172 can be located at various spaced-apart locations on the inwardly facing surface 142 of the interior panel 114, including corners and sides, adjacent the perimeter.

Tensile strap connector 170 is generally a tether that comprises a central strap 174, end 176 and a plurality of extruded grip tabs 178. Tensile strap connector 170 can be made of metal, plastic, or a composite. Tensile strap connectors 170 can be inserted/embedded in or on the back of a concealed ballistic art shield 100 at the time of manufacturing. Accordingly, pre-inserted/embedded tensile strap connectors 170 can be pulled out to an extended state if required, or desired, during use of the shield.

Accordingly, multiple concealed ballistic art shields, such as 100*a* and 100*b* can be connected using tensile strap connectors 170 and shield sleeve supports 172. To connect, a tensile strap connector 170 is inserted through shield sleeve supports 172 of both shields 100*a* and 100*b* including the grip tabs 178. These grip tabs 178 provide a jagged locking arrangement which locks the units together. FIG. 11B depicts an example of such a locked configuration. Once the lower right and lower left corners of the shields are locked together, users can repeat this process to further lock the upper right and upper left shield corners or sides together as well.

Alternatively, slots 174 in the inwardly facing surface 142 can be used instead of the raised shield sleeve supports 172. Slots 174 are generally shown in FIGS. 1, 2, and 4 of this disclosure. This alternative arrangement provides an attachment structure for securing a tether between shields, such as a tensile strap connector 170, and operates in largely the same way as the raised shield sleeve supports 172 where tensile strap connectors 170 are merely slid through the slots 174 of the respective shields and pulled together.

Accordingly, a plurality of concealed ballistic art shields 100 can be clasped and connected together using this method. FIG. 11C shows a front view of three concealed ballistic art shields 100*a*, 100*b*, and 100*c* connected adjacent to one another via tensile strap connectors 170. Having a large shield can be particularly useful in certain scenarios and obfuscate the effectiveness and view of an active shooter or attacker. The shields 100*a*, 100*b*, and 100*c*, shown in FIG. 11*c* have sizeable gaps between them for ease of illustration that are not necessary present. In use, the shields may be secured together such that such that little or no gap is present.

Figure 12:
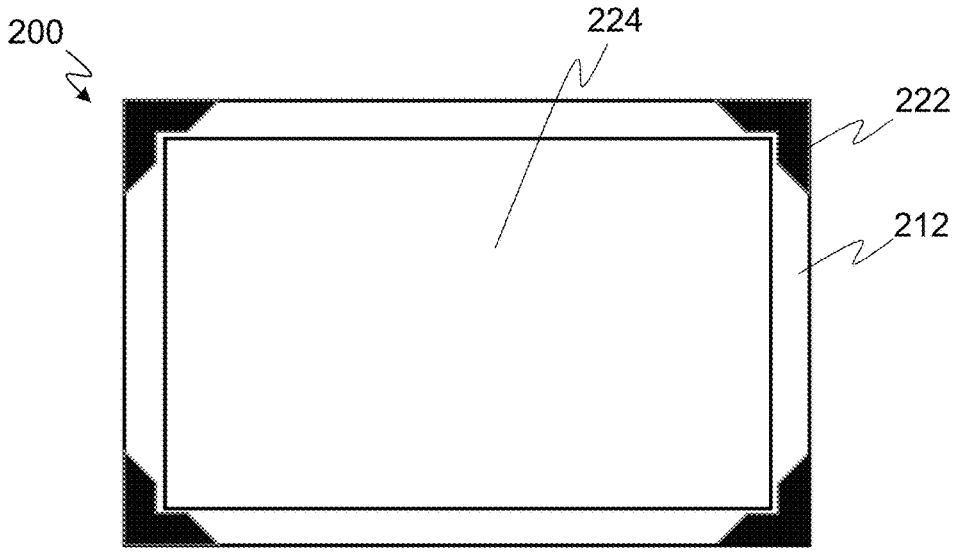
FIG. 12 is a front view of a concealed ballistic art shield, according to an embodiment.
Figure 13:
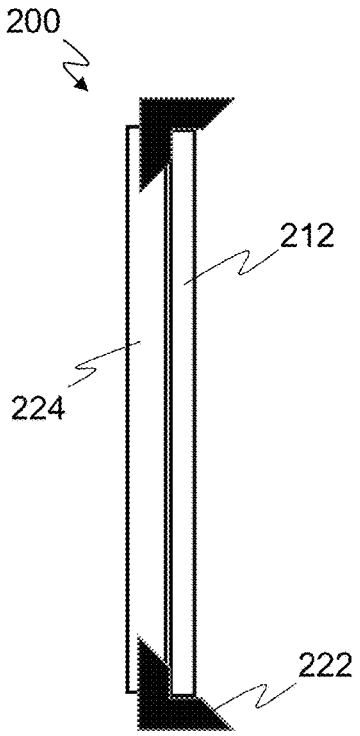
FIG. 13 is a side view of a concealed ballistic art shield, according to an embodiment.
Figure 14:
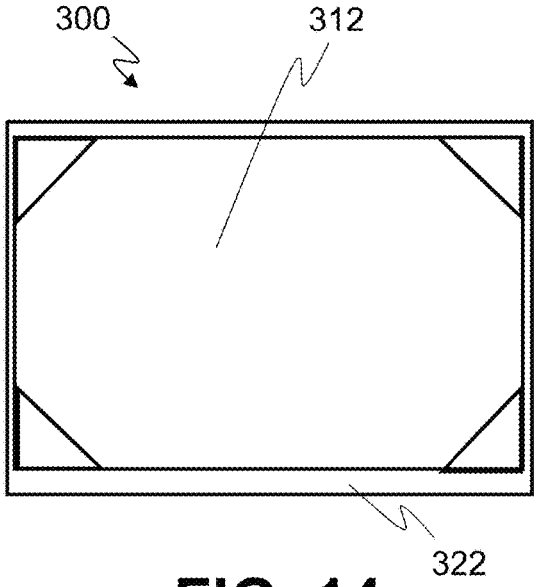
FIG. 14 is a rear view of a concealed ballistic art shield, according to an embodiment.

FIG. 12 shows a further generic embodiment of a front view of a concealed ballistic art shield 200. Similarly, FIG. 13 shows a side view of a concealed ballistic art shield 200. Concealed ballistic art shield 200 shows a somewhat different configuration, which generally provides an art overlay arrangement on a ballistic panel. Specifically, an interior wall décor item 224 is surrounded by ballistic resistant material 212 and a frame 222. Similarly, FIG. 14 shows a rear view of an embodiment of a concealed ballistic art shield 300. Here interior panel 312 overlays a ballistic resistant material (not shown) and is bordered by a frame 322. It should be understood that a various combinations and orders of components are contemplated for configuration of concealed ballistic art shields. Items of concealed ballistic art shields 200 and 300 that are not specifically shown or described should be understood and interpreted consistently with concealed ballistic art shield 100 discussed above.

Figure 15:
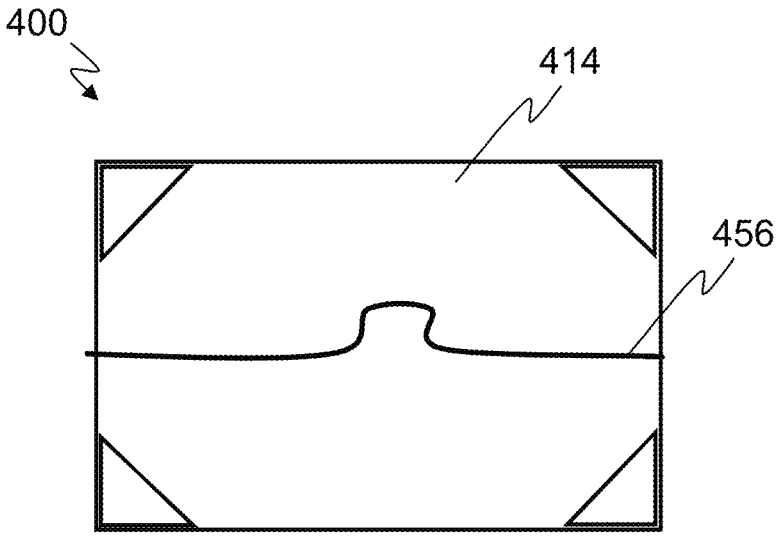
FIG. 15 is a rear view of a concealed ballistic art shield, according to an embodiment.
Figure 16:
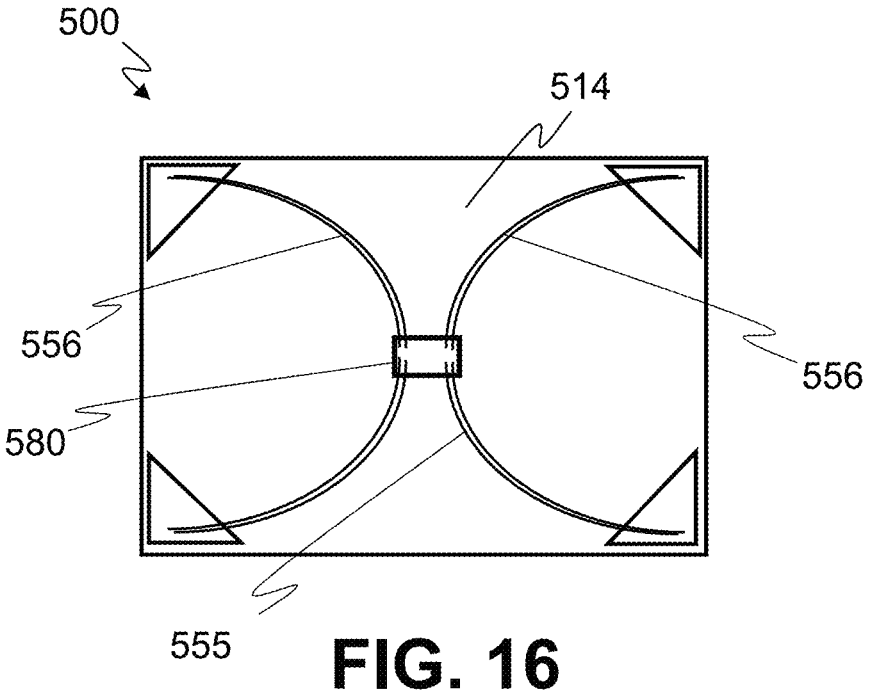
FIG. 16 is a rear view of a concealed ballistic art shield, according to an embodiment.

FIGS. 15 and 16 depict rear views of embodiments of a concealed ballistic art shields 400 and 500, respectively. In FIG. 15, concealed ballistic art shield 400 depicts the interior panel 414 of the shield coupled with a single centrally located handle 456 that is supported horizontally across the back of the shield. A user can readily grip this handle 456 for defensive purposes. In FIG. 16, concealed ballistic art shield 500 depicts the interior panel 514 of the shield coupled with a tension pop-up support handle assembly 555 that includes a pair of arch shaped members 556. Handle assembly 555 is made of semi-rigid, flexible wire under tension or related material. The arch shaped members 556 are connected to the four corners of the interior panel 514 and are connected to a central support 580. The pop-up, expandable and retractable properties of this assembly 555 are convenient for readily collapsing the assembly 555 for wall mounting and expanding the 555 assembly when used as a shield.

Figure 17:
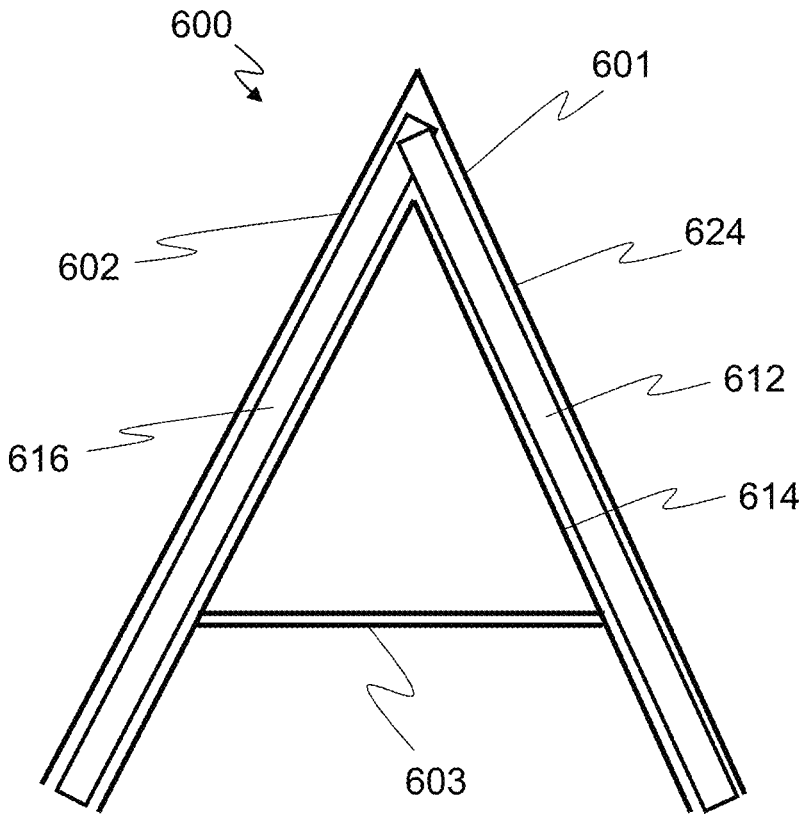
FIG. 17 is a side view of a concealed ballistic art shield incorporating a portable, collapsible, freestanding device, according to an embodiment.

FIG. 17 is a side view of a concealed ballistic art shield 600 comprising ballistic resistant materials embedded within a portable, collapsible, freestanding device, according to an embodiment. Specifically, ballistic art shield 600 can include portable or fixed collapsible signage that is easily set-up for events, entry way guidance, or public information. The underlayment of a ballistic resistant material allows the signage to quickly serve as protection to a nearby person by getting behind, tipping over, or covering under the structure. Embodiments can be mobile in nature so that a person may flee. The configuration shown in FIG. 17 shows a front support 601 in angled operable communication with a rear support 602 and a central brace 603. Front support 601 includes an outer artwork, signage, or other décor item 624, an internal ballistic resistant material 612 and an interior panel 614. Rear support 602 is shown to include a ballistic resistant material 616. In some embodiments artwork or décor 612 can be shown on both the front support 601 and rear support 602. Some embodiments can include an embedded hood for a person to view the way out of the scene without additional exposure. (Not shown).

In other embodiments, ballistic art can consist of ballistic panels that are narrow thin strips secured by a central mount that allows the panels to be expanded similar to a disk or an Asian fan. This allows for more compact storage for improved portability and/or securing to a rail post, entry post or similar elongated sphere. In some embodiments, ballistic art can consist of ballistic panels that are narrow thin triangle strips secured by a central mount that allows the panels to be expanded like an umbrella, and that include a skin providing an additional layer of fabric. This allows for more compact storage, improved portability, and enhanced personal security while walking in public or private domains.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A concealed ballistic art shield, comprising:

an outwardly-facing surface, having a generally planar configuration;

an inwardly-facing surface, oriented in an opposing direction to the outwardly-facing surface, having a generally planar configuration, and including at least one handle;

wherein the at least one handle is tension spring loaded and configured for quick-release adjustment from a low profile position, where the handle is of low profile with respect to the inwardly-facing surface, to a deployed position where the handle extends inwardly for gripping via removal of a detachable release pin that otherwise extends across the inwardly-facing surface and retains the handle; and a ballistic resistant material disposed between the outwardly-facing surface and the inwardly facing surface;

wherein the outwardly-facing surface comprises a shroud for concealing the ballistic resistant material, having a disguised appearance resembling an wall-hung interior wall décor item.

2. The concealed ballistic art shield of claim 1, wherein the wall-hung interior wall décor item is comprised of one or more of the following items: artwork, sign, poster, photograph banner, signboard, painting and graphic.

3. The concealed ballistic art shield of claim 1, wherein the inwardly-facing surface contains a wall mounting structure.

4. The concealed ballistic art shield of claim 1, wherein the at least one handle is configured to recess within the inwardly-facing surface.

5. The concealed ballistic art shield of claim 1, wherein the ballistic resistant material includes one or more of: Kevlar, UHMWPE, Lexan, and carbon fiber composite material.

6. The concealed ballistic art shield of claim 1, wherein the outwardly-facing surface includes a frame.

7. The concealed ballistic art shield of claim 1, wherein the shield contains a plurality of sleeve supports by which the concealed ballistic art shield can be tethered to another concealed ballistic art shield.

8. The concealed ballistic art shield of claim 1, wherein the shield includes an alarm that detects when the ballistic art shield is in use.

9. A concealed ballistic art shield, comprising:

a ballistic resistant material including an outwardly-facing planar surface and an inwardly facing surface oriented in opposing directions;

a frame and wall décor assembly, extending over and around the outwardly-facing planar surface of the ballistic resistant material such that the ballistic resistant material is concealed;

an interior panel extending at least partially over the inwardly facing planar surface of the ballistic resistant material; and wherein the interior panel includes a wall mounting structure and at least one handle adjustable to a low profile position against or recessed within a portion of the interior panel;

wherein the at least one handle is tension spring loaded and configured for quick-release adjustment from the low profile position to a deployed position in which the handle extends inwardly for gripping via removal of a detachable release pin that otherwise extends across the interior panel and retains the handle.

10. The concealed ballistic art shield of claim 9, wherein the frame and wall décor assembly comprises one or more of the following items: artwork, sign, poster, photograph banner, signboard, painting and image.

11. The concealed ballistic art shield of claim 9, wherein the interior panel includes a pair of handles.

12. The concealed ballistic art shield of claim 9, wherein the handle is biased to a deployed position when the detachable release pin constraining the handle is removed.

13. The concealed ballistic art shield of claim 9, wherein the ballistic resistant material includes one or more of: Kevlar, UHMWPE, Lexan, and carbon fiber composite material.

14. The concealed ballistic art shield of claim 9, wherein the shield contains a plurality of sleeve supports by which the concealed ballistic art shield can be tethered to another concealed ballistic art shield.

15. A concealed ballistic art shield, comprising:

a ballistic resistant material including an outwardly-facing planar surface and an inwardly facing planar surface oriented in opposing directions, the ballistic resistant material sized for insertion within an interior perimeter of a wall-hung picture frame;

an interior panel, coupled to the inwardly facing planar surface of the ballistic resistant material;

wherein the interior panel contains a plurality of flanges that extend outwardly beyond the perimeter of the ballistic resistant material and provide attachment locations for mounting the interior panel to a wall-hung picture frame; and wherein the interior panel includes at least one handle adjustable to a low profile position against or within a portion of the interior panel;

wherein the at least one handle is tension spring loaded and configured for quick-release adjustment from the low profile position to a deployed position in which the handle extends inwardly for gripping via removal of a detachable release pin that otherwise extends across the interior panel and retains the handle.

16. The concealed ballistic art shield of claim 15, wherein the interior panel includes a pair of handles.

17. The concealed ballistic art shield of claim 15, wherein the ballistic resistant material includes one or more of: Kevlar, UHMWPE, Lexan, and carbon fiber composite material.

* * * * *